US010842235B2

(12) United States Patent
Buonomo

(10) Patent No.: US 10,842,235 B2
(45) Date of Patent: Nov. 24, 2020

(54) SECURE BUCKLE

(71) Applicant: Watchlock, Marseilles (FR)

(72) Inventor: Sébastien Buonomo, Marseilles (FR)

(73) Assignee: Watchlock, Marseilles (FR)

( * ) Notice: Subject to any disclaimer, the term of this patent is extended or adjusted under 35 U.S.C. 154(b) by 0 days.

(21) Appl. No.: 16/342,294

(22) PCT Filed: Oct. 27, 2017

(86) PCT No.: PCT/EP2017/077662

§ 371 (c)(1),
(2) Date: Apr. 16, 2019

(87) PCT Pub. No.: WO2018/078128

PCT Pub. Date: May 3, 2018

(65) Prior Publication Data

US 2019/0246750 A1 Aug. 15, 2019

(30) Foreign Application Priority Data

Oct. 31, 2016 (FR) ..... 16 60571

(51) Int. Cl.
*A44C 5/24* (2006.01)

(52) U.S. Cl.
CPC ..... *A44C 5/24* (2013.01)

(58) Field of Classification Search
CPC ..... A44C 5/24; A44C 5/22; Y10T 24/4782; Y10T 24/2166; Y10T 24/2155; G04B 37/0008; G04B 37/00; G04B 37/18; G08B 21/22; G08B 21/0288
See application file for complete search history.

(56) References Cited

U.S. PATENT DOCUMENTS

2008/0267014 A1 10/2008 Hyatt

FOREIGN PATENT DOCUMENTS

| | | | |
|---|---|---|---|
| CH | 657763 | A5 | 9/1986 |
| CN | 204812406 | U | 12/2015 |
| EP | 0904709 | A2 | 3/1999 |
| EP | 1279349 | A1 | 1/2003 |
| WO | 2004086895 | A1 | 10/2004 |

*Primary Examiner* — Jack W Lavinder
(74) *Attorney, Agent, or Firm* — 24IP Law Group USA, PLLC; Timothy DeWitt

(57) ABSTRACT

The invention provides an unfoldable buckle (1), comprising an inferior arm (10) and a superior arm (12), hinged with respect to one another as well as a return buckle (20), hinged on the superior arm (12). The buckle may be in a folded position, in which the superior arm is folded on the inferior arm and the return buckle is folded on the superior arm, in a longitudinal direction of the buckle. A locking system (40, 50) is partially accommodated between the return buckle (20) and the superior arm (12) for locking the buckle in a folded position, wherein the locking system is unlockable by a means, unique or uniquely known by and/or available to the wearer, such as for example a removable exterior element (90).

11 Claims, 4 Drawing Sheets

SECURE BUCKLE

BACKGROUND OF THE INVENTION

Field of the Invention

The present invention relates to a buckle for a watch. More precisely, the present invention relates to a unfoldable or deployant buckle.

Brief Description of the Related Art

An unfoldable buckle is a type of clasp for a strap or bracelet of a watch. The unfoldable buckle comprises a system of hinged or articulated arms, which unfolds for opening the bracelet, and which is foldable onto itself during the closure, on the interior face of the bracelet. Such a closure system allows never to disconnect the two parts of the watch bracelet and does generally not risk inadvertently opening.

There are different types of an unfoldable buckle. A simple unfoldable buckle comprises only one joint, which means that the arms of the buckle fold in a "V" under the bracelet on only one side. A dual unfoldable buckle, also called a butterfly unfoldable buckle, comprises two joints, and the arms that are located within the bracelet fold on both sides of the buckle.

In order to prevent an involuntary opening of the buckle, security systems have been developed for locking the closure of the buckle. For example, one or two push-buttons may be located on the side of the casing of the buckle, or a flap may be provided on the buckle. In the two systems, the user has to press on the buttons or unfold the flap for allowing the buckle to unfold. The document CH 657 763 describes such an example of an unfoldable buckle.

However, the traditional unfoldable buckles are fairly readily unlockable by a person with bad intentions, while certain watches are veritable objects of value, since the buttons of the buckle must be pushed for unlocking thereof. A pick-pocket or well-trained thief thus can steel a worn watch.

SUMMARY OF THE INVENTION

An object of the present invention is the improvement of the locking of an unfoldable buckle, notably for protection against theft, in particular against pick-pocketing.

To this end, the invention provides an unfoldable buckle, comprising an inferior arm and a superior arm, hinged or articulated with respect to one another, as well as a return buckle, hinged or articulated on the superior arm; wherein the buckle may assume a folded position, in which the superior arm is folded on the inferior arm and the return buckle is folded on the superior arm, in a longitudinal direction of the buckle; and further comprising a locking system, partly arranged between the return buckle and the superior arm for locking the buckle in a folded position, wherein the locking system is unlockable by a means, unique or uniquely known by, and/or available to the wearer, such as for example a removable exterior element.

According to the invention, the unfoldable buckle may in this way be unlocked only by a means external to the buckle and available to the wearer. In this way it is not possible to unfold an unfoldable buckle without this external means that is preferably unique, which avoids the theft of a worn watch including such an unfoldable buckle. The wearer of the watch can thus arrange for going out with the watch on an arm and leaving the external unlocking means at home, for instance.

According to an embodiment, the locking system comprises at least one of a mechanical locking or an electronic locking. A mechanical locking may comprise for example lock means and barrel keys. An electronic locking may comprise for example a code device or an ergonomic recognition device, such as for example an index sensor, or a device with an RFID-chip.

In an embodiment, the locking system comprises a slider, sliding in a sliding direction, preferably in a transverse direction of the buckle, wherein the slider has a locking recess which cooperates with a locking pin, the locking pin being inserted in the locking recess while the buckle is in a folded position.

The slider may be fixed on the superior arm or the return buckle, and the locking pin may be fixed on the inferior arm. In this way, the locking system is integratable in a way to render it not or hardly visible, when the buckle is folded.

By providing a locking recess with an increasing diameter in the sliding direction, with a blocking zone of a diameter inferior to a maximum diameter of the locking pin, and a passing zone of a diameter superior to the maximum diameter of the locking pin. In this way, by sliding the slider, the dimension of the recess with respect to the locking pin may be varied, for a allowing or not allowing the passage of the head of the locking pin through the recess.

According to an embodiment, the locking system comprises a lock for locking the slider, the lock comprising a set of springs that are aligned with a corresponding set of pistons, wherein, while the buckle is in a folded position and while the springs are at rest, the pistons lead or reach into the slider for blocking the sliding of the slider. A system of the lock type is relatively simple to implement and not very burdensome.

According to an embodiment, the slider has a lateral passage for the introduction of the removable exterior element, wherein in particular the removable element is able to align the pistons for allowing the unblocking of the slider.

According to an embodiment, a return spring is provided for returning the slider into a position, in which the pin is located in the blocking zone while the buckle is in a folded position. Advantageously, the slider is holdable in a position that prevents the opening and the unfolding of the buckle.

In an embodiment of the invention, a set of unique removable means for the unlocking is provided, which allows for a unique rescue means for example in the case of loss of a removable means for the unlocking. Furthermore, by providing an additional unlocking tool, designed to be holdable in place in the buckle in a locked position, in particular with a further device for holding the additional unlocking tool in place in the unfoldable buckle, removing and returning of the removable unlocking means are avoidable once the buckle is locked, for example, in the case, in which a user wishes to wear the unfoldable buckle without the anti-theft device being necessary.

The invention equally proposes a method of unlocking such an unfoldable buckle in a folded position, the method comprising the steps of: unblocking the sliding movement of the slider by means of a key, inserted into the lateral passage; sliding the slider, preferably by pushing by means of the key against the return spring, in order to bring the locking pin, inserted into the locking recess, into coincidence with the passing zone of the recess, for allowing the passage of the locking pin through the recess; and rotating the return buckle or the superior arm in order to unfold the buckle.

A method of locking an unfoldable buckle according to the invention comprises the steps of: unblocking the sliding of the slider, by means of a key inserted into the lateral passage; and sliding the slider, preferably by means of the key, in order to bring the locking pin into coincidence with the passing zone of the recess, in order to allow the passage of the locking pin into the recess; folding the unfoldable buckle and inserting the pin into the recess; and sliding the slider, with or without the key, such that the locking pin is unable to pass through the recess.

BRIEF DESCRIPTION OF THE DRAWINGS

Further features and advantages of the present invention will emerge from the following description with reference to the attached drawings, which illustrate a non-limiting implemented example thereof, among which.

DETAILED DESCRIPTION OF THE INVENTION

Figure 1:
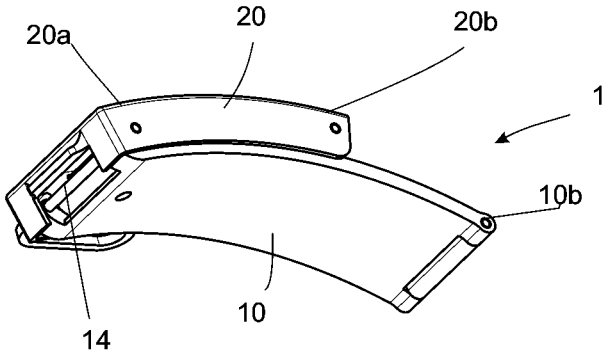
FIGS. 1 and 2 illustrate an unfoldable buckle, in a folded position and in an unfolded position, respectively, according to an embodiment of the present invention.

Throughout the drawings, identical or similar elements are indicated with identical or similar reference numerals.

Figure 2:
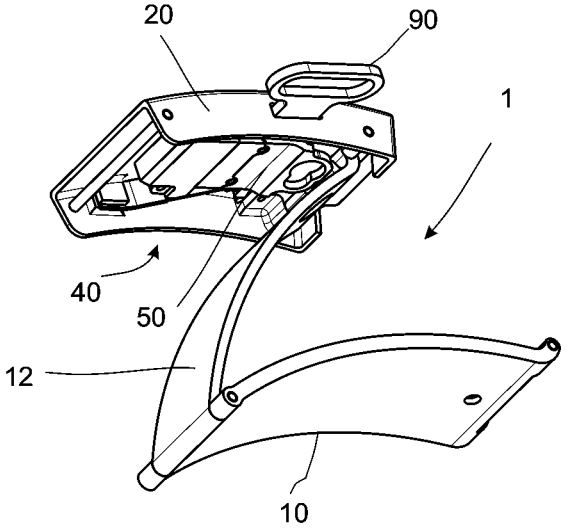
Figure 3:
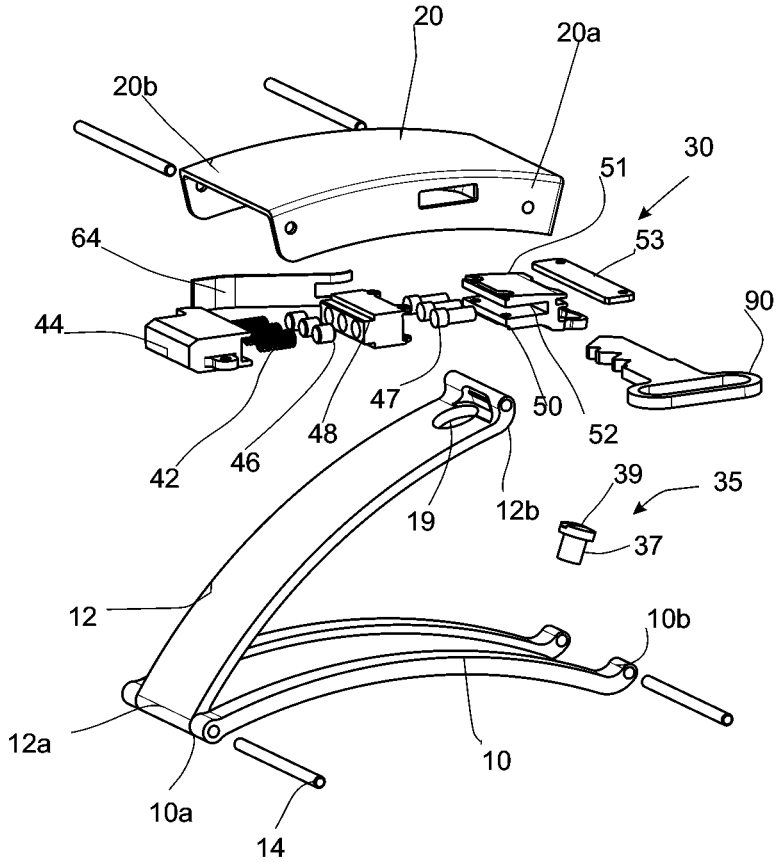
FIG. 3 is an exploded view of the buckle of the FIG. 1 according to an aspect of the present invention.

FIG. 1 illustrates an unfoldable buckle 1 in a folded position, FIG. 2 illustrates the unfoldable buckle 1 in an unfolded position, and FIG. 3 is an exploded view of the unfoldable buckle 1, according to an embodiment of the present invention.

The unfoldable buckle 1 comprises an inferior arm 10, a superior arm 12, hinged on the inferior arm 10, and a return buckle 20, hinged on the superior arm 12 and provided for holding closed the unfoldable buckle 1 in a folded position of the buckle 1.

The superior arm 12 comprises a first superior end 12*a*, rotatably mounted about a hinge 14 to a first inferior end 10*a* of the inferior arm, as well as a second superior end 12*b*, attached to a first end 20*a* of the return buckle 20. The return buckle 20 comprises a second end 20*b* of a casing, which is attachable in a rotatable manner to a strand of the bracelet, and the second inferior end 10*b* of the inferior arm 10 is attachable to another strand of the bracelet (not illustrated).

The buckle 1 may thus pass from an unfolded position to a folded and closed position, in which the superior arm 12 is folded on the inferior arm 10, and is held closed by the return buckle 20 that is folded on the superior arm 12.

The unfoldable buckle of FIGS. 1 and 2 is a simple unfoldable buckle. This merely represents non-limiting example. The unfoldable buckle may equally be a dual or butterfly unfoldable buckle.

A locking system 30 is provided for locking the closure of the return buckle. The locking system 30 is of an external unlocking-type, which means that it is unlockable only with an associated unlocking tool, which is removable, or acts remotely or in a contactless manner. Moreover, the associated unlocking tool may equally be formed by a code device or ergonomic recognition device such as for example an index sensor. The associated unlocking tool is preferably unique and/or uniquely known by, and available to the wearer of the bracelet, which integrates the unfoldable buckle.

In the illustrated embodiment, the locking system comprises a lock 40 of a mechanical type, and the removable tool is a key 90.

Figure 4:
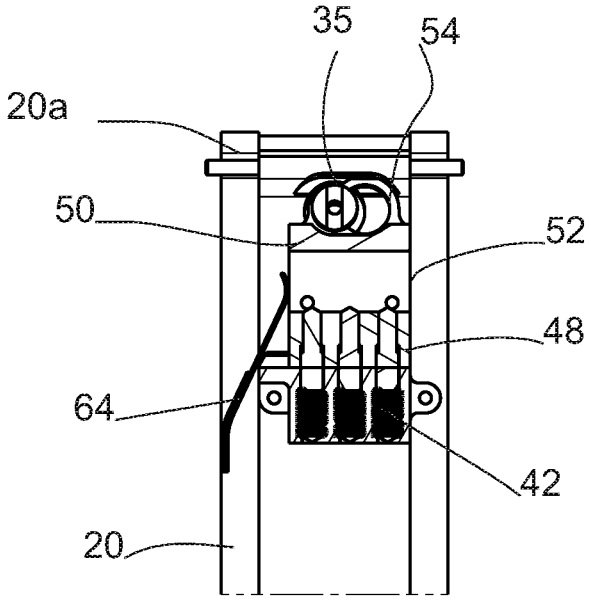
FIG. 4 illustrates a view from above of a locking system, integrated into the buckle of the FIG. 1 according to a further embodiment of the present invention.
Figure 5A:
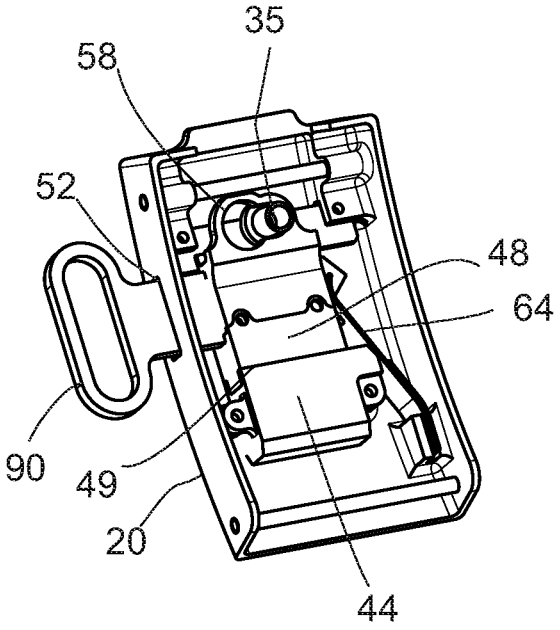
FIGS. 5A and 5B illustrate a locking system integrated into an unfoldable buckle according to an embodiment of the present invention in a locking position or a release position.
Figure 5B:
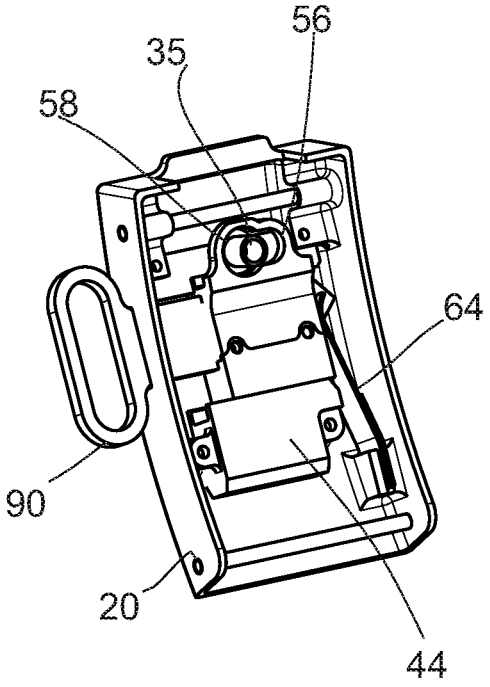

As can be seen in the FIGS. 3 to 5, the lock 40 is arranged under the return buckle and comprises in the illustrated embodiment a set of springs 42, accommodated in a spring holder 44, abutting against a corresponding set of pistons 46, 47 that glide or slide in a piston holder 48.

The springs and the pistons, otherwise referred to as pins, are dimensioned in order to form a key pattern, by varying the length of each piston and/or the stiffness and the length of each spring.

While the springs 42 are at rest, the pistons 46, 47 reach into a slider 50, which comprises a lateral passage 52 for introducing the key 90 therein.

The slider 50 is slidably mounted on a rail 53 for allowing the transverse translation of the slider 50 with respect to the return buckle 20. The slider 50 forms a one-piece member with the piston holder 48, which is slidable along with the slider 50 along a sliding surface 49 of the piston holder 48 with respect to the spring holder.

In the illustrated embodiment the rail 53 is fixed on the return buckle 20.

The slider 50 is provided with a superior wall 51, positioned at an inner side of the return buckle, and comprises a recess 54 for cooperating with a locking pin 35.

The locking pin 35 protrudes from the inferior arm 10 in the direction of the return buckle and has a rod 37, fixed on the inferior arm 10, and a head 39, of a width or diameter superior to the rod 37 (FIG. 3).

The locking pin may be attached and fixed, for example glued or welded, on the inferior arm. The pin may otherwise form an integral part of the inferior arm for a higher strength.

A passage 19 is equally provided in the superior arm 12 for the passing of the locking pin 35.

The recess 54 of the slider 50 is oriented transversely to the return buckle 20 and has a varying diameter, ranging from a blocking zone 56, of a diameter inferior to a diameter of the head 39 of the locking pin 35, to a passing or release zone 58, of a diameter superior to the diameter of the head 39, and thus allowing the passing of the pin 35.

A return spring 64 is laterally positioned for excerpting a return force on the slider 50 towards a resting position, in which the locking pin 35 is located in the blocking zone.

In the illustrated example, the return spring 64 is a flexural spring blade. Other types of return spring may be provided, for example a helical spring, positioned at the lateral wall of the return buckle, opposite to the slider.

While the buckle 1 is folded, the slider is thus held in a resting position, in which the diameter of the head 39 is superior to the diameter of the recess, preventing a passing of the head through the recess in order to exit the recess. In other words, the inferior arm and the return buckle are not able to open, the locking pin being blocked in the recess.

As explained further below, if the key 90 has the associated key pattern, the key inserted into the slider 50 may position the pistons so that the pistons are aligned on the gliding surface 49 of the piston holder 48, the slider 50 and the piston holder 48 being connected and forming a one-piece member. This thus enables allowing the translation or the sliding of the slider 50 in a transverse direction. This sliding enables varying the diameter of the recess with respect to the locking pin 35, allowing the passing of the head thereof for an operation of locking or unlocking of the return buckle. The lock 40, arranged under the return buckle 20, enables thus blocking or releasing the locking pin 35, inserted into the recess of the sliding slider in a folded position of the buckle 1.

It may optionally be provided that the key inserted into the slider may push against the pistons, unblocking the pistons and making the pistons exit the slider 50, in an embodiment.

In the illustrated example, the locking system comprises a lock system with pistons and springs. In this example, the number or the length of the springs may be varied according to the type of locking to be achieved. This example of a lock is not very bulky and is integratable into an unfoldable buckle in a discrete manner.

Other types of locks are conceivable, whether mechanical, electronic or electro-magnetic. For example, a system of a barrel-type is equally conceivable. Furthermore, an electronic locking system, that is unlockable by means of an electronic key, is equally possible. A tool, acting remotely or in a contactless manner, or formed by a code device or an ergonomic recognition device, such as for example an index sensor, is equally conceivable. The external tool is available only to the wearer or to a limited number of persons known to the wearer.

It will be understood that the external and removable tool element, in this case the key, is indispensable for the unlocking, and equally so for the locking of the buckle in a folded position.

Figure 6:
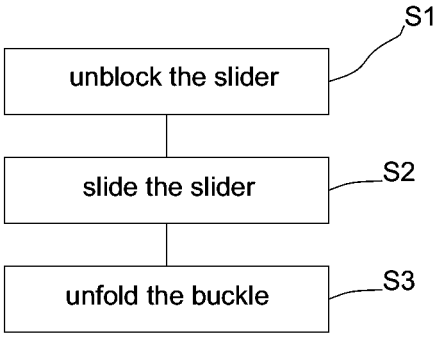
FIG. 6 illustrates a method of locking according to an embodiment of the present invention.

A method of unlocking of an unfoldable buckle 1 is illustrated in FIG. 6 with reference to the buckle described in the FIGS. 1 to 5A-5B.

For allowing the opening of the unfoldable buckle, when the buckle is locked, it is first of all necessary to insert the key into the lateral passage 52 of the sliding slider (step S1) in order to unlock the slider 50.

In a second step S2, the slider 50 is made to slide, preferably by means of the key, in a transverse direction against the return spring 64 in order to bring the locking pin 35, inserted into the locking recess, into coincidence with the passing zone 58 of the recess, for allowing the passing of the locking pin through the recess, and therefor the release of the inferior arm.

Subsequently, the return buckle or the superior arm remains to be rotated in order to unfold the buckle (step S3).

Figure 7:
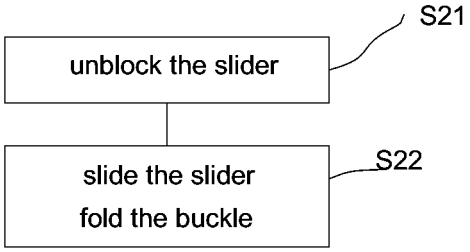
FIG. 7 illustrates a method of unlocking according to an embodiment of the present invention.

In order to lock an unfoldable buckle, as illustrated in FIG. 7, the key 90 has to be inserted into the slider in order to unblock the pistons (S21) and slide the slider, preferably by means of the key, in a transverse direction in order to be able to bring the locking pin 35, located outside the locking recess, into coincidence with the passing zone 58, when the buckle is folded. In parallel or subsequently one folds the unfoldable buckle by taking care that the locking pin 35 passes through the passage 19, provided in the superior arm, and subsequently into the recess 54 of the slider 50 (S22).

Subsequently, the slider slides, either with or without the key, such that the locking pin is not able to pass through the recess. The buckle is locked.

A provision may be made, for example, to provide a user with a set of associated unlocking means, wherein each means of the set is removable and able to unlock the buckle. On the one hand, this allows for alleviating a possible loss of the unlocking tool. On the other hand, an additional unlocking tool may be conceived in order to be able to be held in place in the unfoldable buckle, once locked, by a device holding the tool in the buckle. This option is of interest when the anti-theft protection is not necessary, and the unlocking tool may remain at the watch. This allows for avoiding having to search the tool, especially when the user is at home or with the family. Preferably, the additional unlocking tool is conceived to be held in the unfoldable buckle in a way that is not or little visible, when the additional tool is in place in or on the buckle. In the case of a key, the gripping part may be reduced in order not to go beyond the buckle.

All in all, it will be appreciated that the present invention provides a system of locking an unfoldable buckle with an individual or personalized locking/unlocking tool that preferably is external and removable. In this way, the unlocking of the unfoldable buckle requires a means that is unique or uniquely known by/available to the wearer, such that for example an external and removable tool prevents the watch being pick-pocketed.

The invention claimed is:

1. A unfoldable buckle comprising an inferior arm and a superior arm, hinged with respect to one another, as well as a return buckle (20), hinged on the superior arm, the buckle being able to be in a folded position, in which the superior arm is folded on the inferior arm and the return buckle is folded on the superior arm, in a longitudinal direction of the buckle, a locking system, partially accommodated between the return buckle and the superior arm, for locking the buckle in a folded position, wherein the locking system is unlockable by a means unique to the wearer; and the locking system comprises a slider sliding in a sliding direction, wherein the slider has a locking recess, cooperating with a locking pin, the locking pin being inserted in the locking recess, when the buckle is in a folded position.

2. The unfoldable buckle according to claim 1, in which the locking system comprises at least one of a mechanical locking or an electro-magnetic locking.

3. The unfoldable buckle according to claim 1, wherein the slider is fixed at the superior arm or the return buckle, and the locking pin is fixed at the inferior arm.

4. The unfoldable buckle according to claim 1, which the locking recess has a diameter increasing in the sliding direction, with a blocking zone, of a diameter inferior to a maximum diameter of the locking pin, and a passing zone, of a diameter superior to the maximum diameter of the locking pin.

5. The unfoldable buckle according to claim 1, in which the locking system further comprises a lock for blocking the slider, wherein the lock comprises a set of springs, aligned with a corresponding set of pistons, in which the pistons reach into the slider for blocking the sliding of the slider, when the buckle is in a folded position, and when the springs are at rest.

6. The unfoldable buckle according to claim 1, in which the slider has a lateral passage for the introduction of a removable exterior element, the removable element being able to align pistons in order to allow the unblocking of the slider.

7. The unfoldable buckle according to claim 1, comprising a return spring for returning the slider into a position in which the locking pin is located in a blocking zone when the buckle is in a folded position.

8. The unfoldable buckle according to claim 1, further comprising a set of unique removable means for unlocking, in which the set of unique removable means comprises an unlocking tool, configured to be holdable in place in the buckle in a locked position.

9. The unfoldable buckle according to claim 8 comprising a device holding the additional unlocking tool in place in the unfoldable buckle.

10. The unfoldable buckle according to claim 1, wherein the locking system is unlockable by a removable exterior element.

11. The unfoldable buckle according to claim 1, wherein the locking system comprises a slider sliding in a transverse direction of the buckle.

* * * * *